US005315065A

United States Patent [19]

O'Donovan

[11] Patent Number: 5,315,065

[45] Date of Patent: May 24, 1994

[54] VERSATILE ELECTRICALLY INSULATING WATERPROOF CONNECTORS

[76] Inventor: James P. O'Donovan, 21 Huntoon St., Dorchester, Mass. 02124

[21] Appl. No.: 933,485

[22] Filed: Aug. 21, 1992

[51] Int. Cl.[5] ..... H01R 4/18; H01R 43/04

[52] U.S. Cl. ..... 174/84 C; 174/84 R; 439/879; 439/880; 29/871; 29/872

[58] Field of Search ..... 174/22 R, 22 C, 84 R, 174/84 C, 88 R; 439/877, 879, 880, 882; 29/871, 872

[56] References Cited

U.S. PATENT DOCUMENTS

| | | | |
|---|---|---|---|
| 2,958,723 | 11/1960 | Logan et al. | 174/84 C |
| 3,015,683 | 1/1962 | O'Keefe et al. | 174/84 C |
| 3,137,925 | 6/1964 | Wahl | 439/879 X |
| 3,383,642 | 5/1968 | Nava et al. | 174/84 R X |
| 3,525,799 | 8/1970 | Ellis | 174/84 R |
| 3,613,048 | 10/1971 | Brundza | 339/89 R |
| 3,826,860 | 7/1974 | De Sio et al. | 439/880 X |
| 4,370,518 | 1/1983 | Guzy | 174/84 R |
| 4,501,927 | 2/1985 | Sievert | 174/84 R X |
| 4,560,219 | 12/1985 | Chapelot | 339/60 R |
| 4,839,470 | 6/1989 | Ventura | 174/84 C X |
| 4,839,473 | 6/1989 | Fox et al. | 174/138 F |
| 4,917,620 | 4/1990 | Samejima et al. | 439/272 |
| 4,948,378 | 8/1990 | Hoshimo | 439/271 |
| 5,132,495 | 7/1992 | Ewing et al. | 174/84 C X |

*Primary Examiner*—Mark Rosenbaum
*Assistant Examiner*—S. Thomas Hughes
*Attorney, Agent, or Firm*—Morse, Altman, Dacey & Benson

[57] ABSTRACT

A versatile, electrically insulating, waterproof electrical junction and a method of forming the same are disclosed. The electrical junction comprises three layers to effect waterproof encapsulation of two electric leads: a first layer defined by a pair of rubber collars for each of the two leads; a second layer defined by a pair of metal sleeves, a male and a female sleeve; and a third layer defined by a rubber sheath surrounding and encompassing both layers. The three-layered electrical junction preferably is the first and the seconcrimped along its entire axial length to compact the three layers into a waterproof electrical connector characterized by a high packing density.

7 Claims, 1 Drawing Sheet

VERSATILE ELECTRICALLY INSULATING WATERPROOF CONNECTORS

FIELD OF THE INVENTION

The present invention relates to waterproof electrical junctions, particularly waterproof electrical connectors and processes which create waterproof electrical connections directly between two or more wire leads.

THE PRIOR ART

As is well known, the ordinary waterproof electrical junction is defined by two conductors that are mechanically and electrically joined by one of two types of waterproof electrical connectors: (1) a pair of male and female connecting units or (2) a single tubular unit. Each such unit includes at least one enclosure that extends throughout an electrically connected region between two conductors. The types of enclosures and the manner they are arranged about the electrical connectors varies.

A pair of engaged male and female connecting units, such as those taught by Chapelot in U.S. Pat. No. 4,560,219 or Brundza in U.S. Pat. No. 3,613,048, typically comprise one of three types of enclosures: terminal enclosures, linking enclosures, and attached linking enclosures. Terminal enclosures, located in one or both connecting units, overlap with the insulating sheaths of the external conductors and contain each of the external conductor terminals in a cavity. Linking enclosures, located in each connecting unit adjacent to terminal enclosures, contain internal conductors that extend throughout the unit to exposed contact terminals on the unit's mating surface. Attached linking enclosures contain the internal conductors of both connecting units and are mechanically and electrically connected by contacting terminals nested within a linking waterproof cavity formed by the units' mating surfaces.

In the case of a tubular single unit connector, there is a single deformable terminal enclosure, which comprises a male tubular unit partially engaged with a plastic female tubular unit. Two wires are inserted into each end of the attached units and the entire assemblage is crimped such that the tubular layers are compressed over the insulating sheaths of both wires.

Despite their utility, the prior structure of a pair of male and female connecting units and a deformable tubular enclosure have not been successful in the formation of a secure waterproof connection directly between two or more contact terminals, as would be desirable in household, automotive and marine settings. First, the linking and attached linking enclosures in a pair of connecting units are relatively bulky assemblages which separate two contact terminals, preventing connections directly between contact terminals. Further, their terminal enclosures accommodate only one conductor, preventing the waterproof connection of three or more conductors. Second, the deformable but rigid layers constituting the terminal enclosure of a single tubular unit form gaps between the insulating sheaths of conductors when crimped, causing the conductors to be loose and the ensuing junction to leak.

Conventional waterproof electrical connectors, then, often do not form a secure waterproof connection directly between two or more wire leads. Connectors which are a pair of male and female connecting units form indirect electrical connections between a single pair of conductor terminals. And the layers of single unit tubular connectors do not snugly conform against the insulating sheaths of conductors, forming leaky cavities and loose unpredictable connections. Accordingly, it is desired that waterproof connectors comprise enclosures capable of accommodating two or more contacting wire leads and capable of forming a secure hermetically sealed waterproof cavity about a junction so formed.

BRIEF DESCRIPTION OF THE INVENTION

The object of the present invention is to structurally provide a novel waterproof connector comprising of a plurality of enclosures sufficiently versatile to accommodate two or more conductors and to be composed of materials so that such a connector, surrounding two or more contacting wire leads, may be deformed by externally applied pressure into a secure hermetically sealed, electrically conducting assemblage.

The present invention generally comprises a metallic male tubular sleeve, a metallic female tubular sleeve, interior rubber collars and an exterior rubber sheath all engaged about two or more wires in such a manner that the wires are directly connected by contacting wire leads and securely fastened within a hermetically sealed waterproof encapsulation. The metallic male and female sleeves, composed of deformable metallic materials, mate with each other forming a tubular structure. The rubber collars, composed of a tacky rubber, snugly encompass the insulating sheaths of the connecting wires. The insulated conductors are disposed snugly within the metallic sleeves in such a way that the leads of the two conductors are in intimate contact. The rubber sheath, composed of a tacky rubber, is slid over the packed metallic sleeves, overlapping the insulating sheaths of the wires. External pressure is applied throughout a wide length of the rubber sheath, for example by a wide jaw crimping tool. The resulting arrangement is such that the entire unit is deformed into an electrically conducting waterproof assemblage including an interior in the live conductors are locked firmly in electrical and mechanical contact. The process is relatively quick and efficient so that it can be performed readily in automotive, household or marine settings.

A more specific object of the invention is to provide an electrical junction comprising a first wire, a second wire, a rubber collar about the first wire, a rubber collar about the second wire, a metallic sleeve having a male deformable part and a female deformable part about the rubber collars, and a rubber sheath about the metallic sleeve. The first and second wires have free metallic leads and insulating sheaths, and each wire is enveloped by a rubber collar in such manner that the rubber collars fit snugly over the insulating sheaths. The male deformable part projects into the female deformable part in such manner that the female deformable part envelops the first wire and overlaps the first metallic lead, and the male deformable part envelops the second wire and overlaps the second metallic lead. This enables in the first and second metallic leads to become mechanically and electrically connected securely.

The rubber outer sleeve envelops the male deformable part, the female deformable part, the first rubber collar, the second rubber collar, the first lead, and the second lead. The entire junction may be crimped hermetically to weld the outer rubber sleeve to the rubber collars in order to hermetically seal the first lead and second lead into an intimate mechanical and electrical contact within a waterproof enclosure.

DETAILED DESCRIPTION OF THE EMBODIMENT

Figure 1:
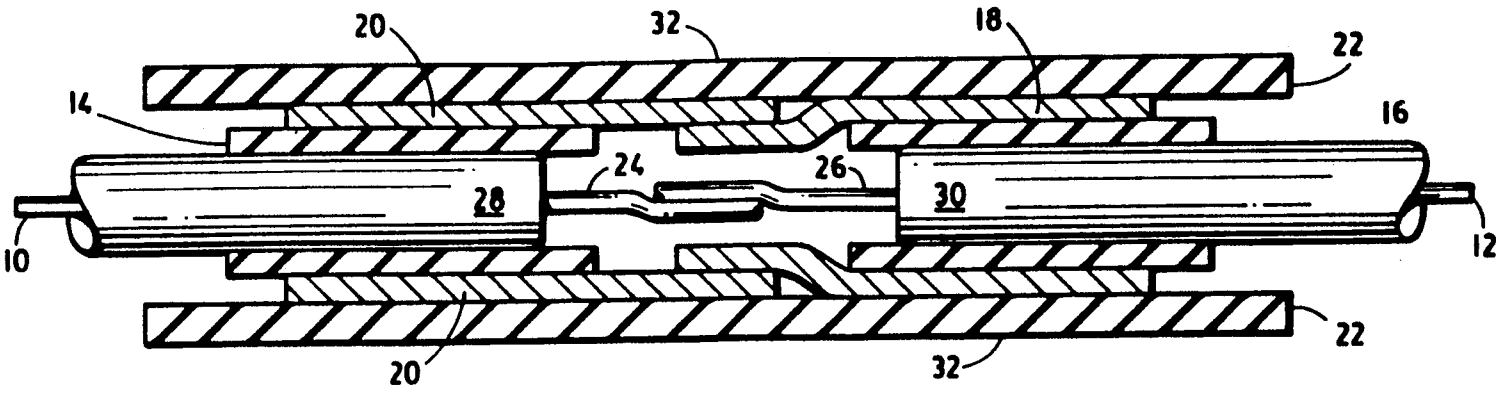
FIG. 1 is a cross sectional view along the axis of a preferred embodiment in a preliminary uncrimped condition, with two wire leads in contact.

The Electrical Junction of FIG. 1

The assemblage, as shown in FIG. 1, comprises a wire 10, a wire 12, a rubber collar 14, a rubber collar 16, a male metallic sleeve 18, a female metallic sleeve 20, and a rubber sheath 22. Wire 10 is encompassed by rubber collar 14 and wire 12 is encompassed by rubber collar 16. A first lead 24, and a second lead 26 are manipulated to mechanically and electrically link leads 24 and 26. This arrangement is such that rubber sleeve 22, rubber collars 14, 16, and metallic sleeves 18, 20 conform snugly over the outer surface of insulating sheaths 28, 30.

As shown, the outer surface 32 of rubber sheath 22 is adapted to receive externally applied pressure which deforms rubber sheath 22, rubber collars 14, 16 and metallic tubular enclosures 18, 20 into the waterproof electrical junction to be described below in reference to FIG. 2. Rubber collars 14, 16, for example, are composed of a tacky elastomer such as partially vulcanized or cross linked rubber. Rubber sleeve 22 is composed of a less tacky rubber for example, an elastomer such as partially vulcanized or cross linked rubber. The rubber of both collars is sufficently tacky so that it is extrudable by externally applied pressure and sufficiently adhesive to become an integrated continuum.

The present embodiment, then, includes a plurality of concentric enclosures which conform snugly over two or more contacting wire leads and their adjoining insulating sheaths. The enclosures are composed of materials such that when external pressure is applied, the layers defining rubber collars 14, 16, metallic sleeves 18, 20, and rubber sleeve 22 become a densely packed, watertight encapsulation which securely binds wires 10, 12 together in a watertight environment.

Figure 2:
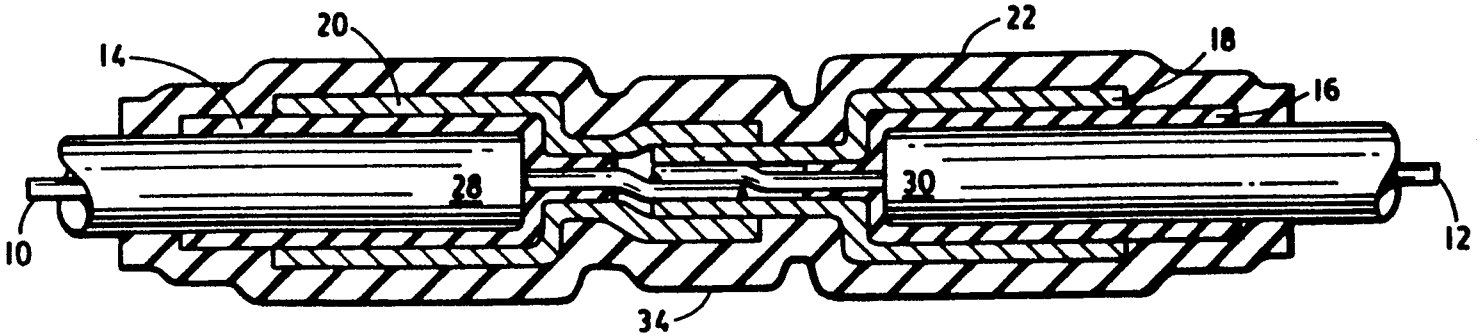
FIG. 2 a cross sectional view along the axis of the preferred embodiment in a crimped condition, forming a waterproof hermetic seal about the junction of the wire leads.

The Waterproof Electrical Junction of FIG. 2

The waterproof electrical junction, shown at FIG. 2, which results from crimping the assemblage of FIG. 1, comprises a wire 10, a wire 12 which are mechanically and electrically connected by their wire leads 24, 26, snugly within waterproof encapsulation 34.

As shown, waterproof encapsulation 34 is bordered by deformed layers including rubber collars 14, 16, metallic sleeves 18, 20, and rubber sheath 22. The arrangement is such that the concentric tubular layers defining rubber collars 14, 16, metallic sleeves 18, 20 and rubber sheath 22 are compressed snugly against each other, thereby securely fastening wire leads 24, 26 together. The ensuing junction has a high packing density and provides a waterproof electrical connection.

More specifically, as illustrated in FIG. 2, the crimped waterproof, electrically conducting assemblage contains a first wire 10 with first metallic lead 24 mechanically and electrically connected to a second wire 12 with metallic lead 26. As shown, the junction is in its crimped condition, such that rubber sleeve 22, rubber collars 14, 16, male sleeve 18, and female sleeve 20 form a hermetic layer encompassing first metal lead 24, second metal lead 26 and adjoining regions of insulating sheaths 28, 30. The inner surface of rubber sheath 20, and the rubber collars are partially vulcanized and therefore tacky, so that rubber collars 14 and 16, rubber sheath 20, male sleeve 16, and female sleeve 18 mesh into a continuous waterproof encapsulation.

OPERATION

In operation, the assemblage of FIG. 1 comprises a pair of connectors that initially are manipulated into mating contact. Once in mating contact, the connectors are crimped to produce encapsulating contact. When crimped portions of an exterior rubber sheath and interior rubber collars flow together and form integral seals. The result is a secure electrical and mechanical junction.

What is claimed is:

1. An assemblage for joining at least a first wire including a first metallic lead and a first insulating sheath, and a second wire including a second metallic lead and a second insulating sheath; said assemblage comprising:
   (a) a first rubber collar for enveloping said first wire including a portion of said first metallic lead;
   (b) a second rubber collar for enveloping said second wire including a portion of said second metallic lead;
   (c) a female deformable metal sleeve for enveloping said first rubber collar and said first wire and centrally overlapping said first metal lead;
   (d) a male deformable metal sleeve for enveloping said second rubber collar and said second wire and centrally overlapping said second metallic lead;
   (e) said male deformable metal sleeve for projecting into said female deformable metal sleeve; and
   (f) a rubber outer sheath for enveloping said male sleeve, said female sleeve, said first collar, said second collar, said first lead, and said second lead.

2. The assemblage of claim 1 wherein the said rubber collars and said rubber sheath are composed of a rubber selected from the class consisting of partially cross linked rubber.

3. An electrical junction comprising:
   (a) a first wire including a first metallic lead and first insulating sheath;
   (b) a second wire including a second metallic lead and a second insulating sheath;
   (c) said first metallic lead and said second metallic lead being physically joined in overlapping relation to one another to effect on electrical connection therebetween;
   (d) a first rubber collar enveloping said first wire and a portion of said first metallic lead;
   (e) a second rubber collar enveloping said second wire and a portion of said second metallic lead;
   (f) a female deformable metal sleeve enveloping said first rubber collar and said first wire and overlapping said first metal lead;
   (g) a male deformable metal sleeve enveloping said second rubber collar and said second wire and overlapping said second metallic lead;
   (h) said male deformable metal sleeve projecting into said female deformable metal sleeve; and (i) a rubber outer sheath enveloping said male sleeve, said female sleeve, said first collar, said second collar, said first lead, said second lead;

(j) said electrical junction being crimped to hermetically join said outer rubber sheath to said rubber collars in order to hermetically seal said male sleeve, said female sleeve, said first lead and second lead into intimate mechanical and electrical contact with one another.

4. The electrical junction of claim 3 wherein the said rubber collars and said rubber sheath are composed of a rubber selected from the class consisting of partially cross linked rubber.

5. A waterproof electrical connector for joining at least a pair of insulated electric leads comprising:

(a) at least a pair of insulated electric leads, each having a free end with an exposed lead segment physically joined in overlapping relation to one another to effect an electrical link between said exposed lead segments;

(b) a pair of rubber collars, one for each of said pair of insulated electric leads which overlie the free ends thereof, including portions of said exposed lead segments;

(c) a pair of metal sleeves, one male and one female overlying both said pair of rubber collars and said exposed lead segments physically joined to one another; and (d) a rubber sheath encapsulating said pair of rubber collars and said pair of metal sleeves, which sheath, when crimped, effects a waterproof electrical connection between said exposed lead segments and a high packing density between said collars, said sleeves and said sheath.

6. The waterproof electrical connector of claim 5 wherein said rubber collars, said metal sleeves and said rubber sheath are all concentrically deformed about each other, when crimped, to effect said high packing density therebetween.

7. The waterproof electrical connector of claim 5 wherein said rubber collars and said rubber sheath are formed of partially cured rubber so as to be tacky when crimped.

* * * * *